US011830695B2

(12) United States Patent
Poczontek et al.

(10) Patent No.: US 11,830,695 B2
(45) Date of Patent: Nov. 28, 2023

(54) REINFORCED HOUSING FOR AN INDUSTRIAL SWITCHING DEVICE

(71) Applicant: Rockwell Automation Switzerland GmbH, Aarau (CH)

(72) Inventors: Dariusz Poczontek, Katowice (PL); Hanspeter Hochuli, Aarau (CH); Sandro Liberto, Aarau (CH); Sadashiv Pimple, Aarau (CH)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 83 days.

(21) Appl. No.: 17/481,957

(22) Filed: Sep. 22, 2021

(65) Prior Publication Data

US 2023/0088972 A1 Mar. 23, 2023

(51) Int. Cl.
*H01H 9/02* (2006.01)

(52) U.S. Cl.
CPC ..... *H01H 9/02* (2013.01)

(58) Field of Classification Search
CPC ..... H01H 9/02; H01H 33/18; H01H 33/08; H01H 33/74; H01H 9/30; H01H 9/32; H01H 9/285; H01H 33/10; H01H 9/342; H01H 9/302; H01H 89/04; H01H 71/46; H05K 7/02
USPC ..... 200/293, 303; 218/15, 34, 38, 46
See application file for complete search history.

(56) References Cited

U.S. PATENT DOCUMENTS

| | | | | |
|---|---|---|---|---|
| 7,964,811 | B2 * | 6/2011 | Lin | A61P 25/00 200/302.2 |
| 9,704,676 | B1 | 7/2017 | Cardwell | |
| 10,056,210 | B2 * | 8/2018 | Marzano | H01H 9/342 |
| 10,840,035 | B1 | 11/2020 | Strebel Marzano et al. | |

FOREIGN PATENT DOCUMENTS

| | | |
|---|---|---|
| DE | 103 56 270 A1 | 6/2005 |

OTHER PUBLICATIONS

Extended European Search Report dated Feb. 10, 2023; Application No. 22196338.2—(10) pages.

* cited by examiner

*Primary Examiner* — Renee S Luebke
*Assistant Examiner* — Iman Malakooti
(74) *Attorney, Agent, or Firm* — Boyle Fredrickson, S.C.

(57) ABSTRACT

The invention relates to a switching device including a housing having a front housing and a rear housing. The rear housing includes a rear housing face, and a first sidewall, first end a second sidewall, and a second end wall projecting from the rear housing face to form at least one interior chamber. The sidewalls of the rear housing include a rear housing tab that projects away from the rear housing face. The switching device further includes a splitter plate support, comprising first and second support panels, located within the interior chamber. The first support panel further includes a support hook that extends from the outer panel face. The support hook has an aperture that engages the rear housing tab, in which the rear housing tab extends through the aperture of the support hook, forming a double-walled panel and reinforcing the housing.

20 Claims, 19 Drawing Sheets

REINFORCED HOUSING FOR AN INDUSTRIAL SWITCHING DEVICE

BACKGROUND INFORMATION

The subject matter disclosed herein relates to circuit interrupting or switching devices. More specifically, an aspect of the invention relates to switching devices that include a mechanism and method of reducing or preventing distortion and destruction of a housing of the switching device through a reinforced housing.

As is known to those skilled in the art, various switching devices are currently available and may be used for interrupting or breaking an electrical current between a source of electrical power and a load. Typically, switching devices have an "ON" and an "OFF" state, where in the ON state, the switching device establishes an electrical connection between contacts and allows electrical current to flow through the switching device from a power source to an electrical load. In the OFF state, the switching device opens, or breaks, the electrical connection between contacts, preventing the electrical current from flowing through the switching device. These switching devices may take the form of circuit breakers, contactors, relays, motor starters and the like. Upon opening or separating the contacts, an electrical arc may be generated. The switching device further must be able to withstand electrical arcs, and short circuits, multiple times in order to be certified for use. The generation of the electrical arc and/or short circuits result in an increase in temperature and pressure inside the switching device which may damage, the contacts of the switching device, the device itself, or the load that is being protected.

While there have been various approaches to improve extinguishing an arc in a circuit interrupter or reducing damage, there is a need for further improvement in the containment of the arc pressure generated as a result of the circuit interruption event to prevent damage to the switching device.

BRIEF DESCRIPTION

The invention relates to a switching device for industrial equipment. According to one embodiment of the invention, the switching device includes a housing having a front housing and a rear housing that couple to form the housing. The rear housing includes a rear housing face, a first sidewall, a second sidewall, a first end wall, and a second end wall. The second sidewall is located opposite the first sidewall, and the second end wall is located opposite the first end wall. Each of the first sidewall, second sidewall, first end wall, and second end wall extend from the rear housing face to define at least one interior chamber therebetween. A rear housing tab extends from the first sidewall of the rear housing. The switching device further includes a splitter plate support that is located within the at least one interior chamber. The splitter plate support includes a first support panel, and the first support panel includes an outer panel face configured to be orientated so that it is adjacent to the first sidewall of the rear housing. The first support panel further includes a support hook that extends from the outer panel face. The rear housing tab engages the support hook to, at least in part, connect the first support panel to the first sidewall of the rear housing.

According to another embodiment of the invention, a switching device for industrial equipment includes a housing having a front housing configured to be mounted to a rear housing. A rear housing tab extends from the rear housing toward the front housing. The switching device also includes a splitter plate support having a first support panel. The first support panel includes an aperture, and the rear housing tab is configured to extend through the aperture when the splitter plate support is mounted with the rear housing.

According to still another embodiment of the invention, a method of reinforcing side walls of a housing of a switching device for industrial equipment is disclosed. A splitter plate support is inserted into a rear housing of the switching device in which a way that a support hook of the splitter plate support engages with a rear housing tab, where the rear housing tab extends from a side wall of the rear housing. The rear housing is mounted to the front housing so that a sidewall of the front housing extends over the rear housing tab and support hook. The sidewall of the front housing is generally coplanar with the sidewall of the rear housing when the front housing is mounted to the rear housing, and the sidewalls of the front housing and of the rear housing define a sidewall of the housing of the switching device.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Various exemplary embodiments of the subject matter disclosed herein are illustrated in the accompanying drawings in which like reference numerals represent like parts throughout, and in which.

Figure 1:
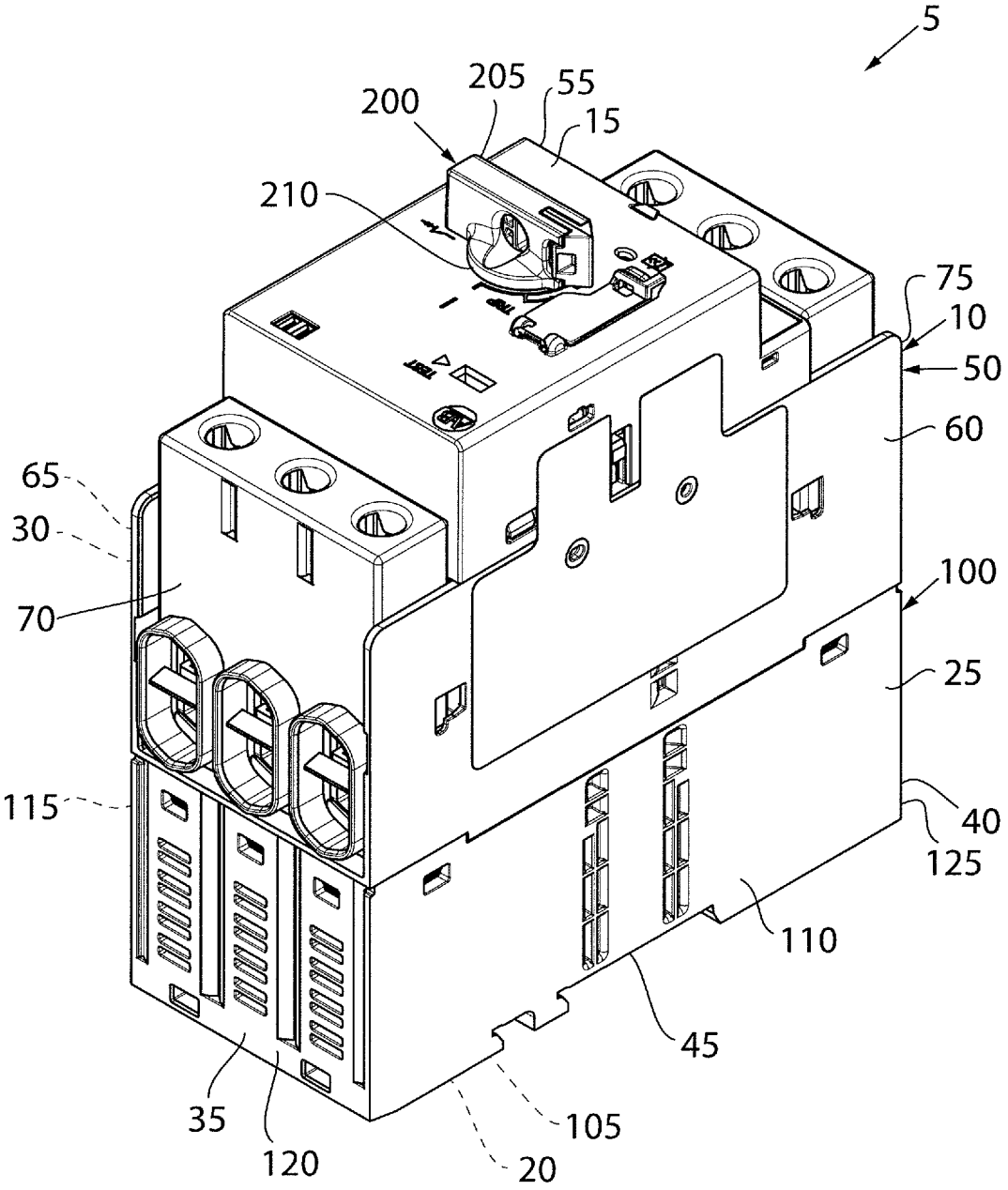
FIG. 1 is a perspective view of a switching device.

In describing the various embodiments of the invention Which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION

The various features and advantageous details of the subject matter disclosed herein are explained more fully with reference to the non-limiting embodiments described in detail in the following description.

The subject matter disclosed herein describes a reinforced housing of a switching device for containment of arc pressure generated as a result of a circuit interruption event to prevent damage to the switching device. The housing of the switching device includes a front housing and a rear housing and is reinforced through the engagement of a support panel with the rear housing. A rear housing tab extending from the rear housing engages with a support panel of a splitter plate support. The splitter plate support extends from the splitter plate for engagement with the rear housing tab. The splitter plate support includes a hook with an aperture extending through the hook. The rear housing tab extends through the aperture located within the hook, and the rear housing tab and support hook engagement prevent lateral movement between the sidewall of the rear housing and the sidewall of the front housing. Additionally, the sidewall of the front housing extends over a portion of the sidewall of the rear housing and the two sidewalls are generally coplanar when front housing is mounted to the rear housing. Thus, not only does the engagement of the rear housing tab and support hook resist lateral movement of the sidewalls of the rear housing with respect to the front housing during short circuit events, the overlapping rear housing and support panel further form a double-walled region within at least one region of the housing to further reinforce the housing. The reinforced housing is therefore better able to withstand pressure resulting from short circuit events and reduce the likelihood of damage to the switching device.

Terms such as upper, lower, inner, outer, front, rear, left, right, and the like will be used herein with respect to an illustrated switching device 5 as shown in FIG. 1. These terms are relational with respect to the illustrated switching device and are not intended to be limiting. It is understood that the switching device 5 may be installed in different orientations, such as vertical or horizontal, or may be rotated one hundred eighty degrees without deviating from the scope of the invention.

Referring to FIG. 1, the switching device 5 may be a molded case circuit breaker mounted in a cabinet (not shown) and used to control industrial equipment. According to the illustrated embodiment, the switching device 5 includes a housing 10, which has a top face 15, a bottom face 20 located opposite from the top face 15, a first sidewall 25, a second sidewall 30 located opposite from the first sidewall 25, a first end wall 35, and a second end wall 40 located opposite from the first end wall 35. Each face 15, 20 or wall 24, 30, 35, or 40 may be generally rectangularly shaped to form a generally rectangular housing 10. In various embodiments, the housing 10 may be shaped differently or include various protrusions or indentations.

The housing 10 may further include a Deutsches Institut fur Normung (DIN) slot 45 located and positioned at the bottom face 20. The DIN slot 45 is an indention shaped and sized so that a DIN rail (not shown) may engage the DIN slot 45 to allow the switching device 5 to be mounted and secured within a cabinet (not shown). The housing 10 further includes a front housing 50 and a rear housing 100 which couple to form the housing 10. The front housing 50 is located towards the front of the housing 10, while the rear housing 100 is located near the back of the housing 10.

The front housing 50 includes a front housing face 55 (forming the top face 15 of the housing 10), a first sidewall 60 (forming a portion of the sidewall 25), a second sidewall 65 (forming a portion of the sidewall 30), a first end wall 70 (forming a portion of the end wall 35), and a second end wall 75 (forming a portion of the end wall 40). The first 60 is located opposite to a second sidewall 65, and the first end wall 70 is located opposite to the second end wall 75. The sidewalls 60, 65 and end walls 70, 75 all extend away from the front housing face 55 to form the front housing 50, a shell or portion of the housing 10. Similarly, the rear housing 100 also includes a rear housing face 105 (which forms the bottom face 20), a first sidewall 110 (forming a portion of the sidewall 25), a second sidewall 115 (forming a portion of the sidewall 30), a first end wall 120 (forming a portion of the end wall 35), and a second end wall 125 (forming a portion of the end wall 40). The sidewalls 110, 115 and end walls 120, 125 form a perimeter around the rear housing face 105 and extends therefrom to form an interior chamber 128 within the rear housing 100.

Thus, together, the first sidewalls 60, 110 of the front and rear housings 50, 100 form the first sidewall 25 of the housing 10, the second sidewalls 65, 115 of the front and rear housings 50, 100 form the second sidewall of the housing 10, the first end walls 70, 120 of the front and rear housings 50, 100 form the first end wall 35 of the housing 10, and the second end walls 75, 125 of the front and rear housings 50, 100 form the first end wall 40 of the housing 10. The front housing 50 and rear housing 100 overlap for at least a short distance where they join and may engage each other in a snap connection. Alternately, or in combination with the snap connection, the front housing 5 and rear housing 100 may couple through other methods in various embodiments of the invention such as a friction fit or with a mechanical coupler such as a screw.

The switching device 5 further includes an actuator 200 that extends through the front housing face 50 and is configured to engage a plunger (not shown) which moves in a back-and-forth motion along an axis thereby allowing the plunger to move between a first position and a second position so that the switching device 5 moves between a corresponding first state and a second state. In a first state, the contacts are closed or adjacent to each establishing an electrical connection. In the second state, the contacts are open or separated to break the electrical connection between the contacts. The actuator 200 may be manually activated by, for example, a toggle switch or a handle 205 on a rotary switch 210.

Figure 2:
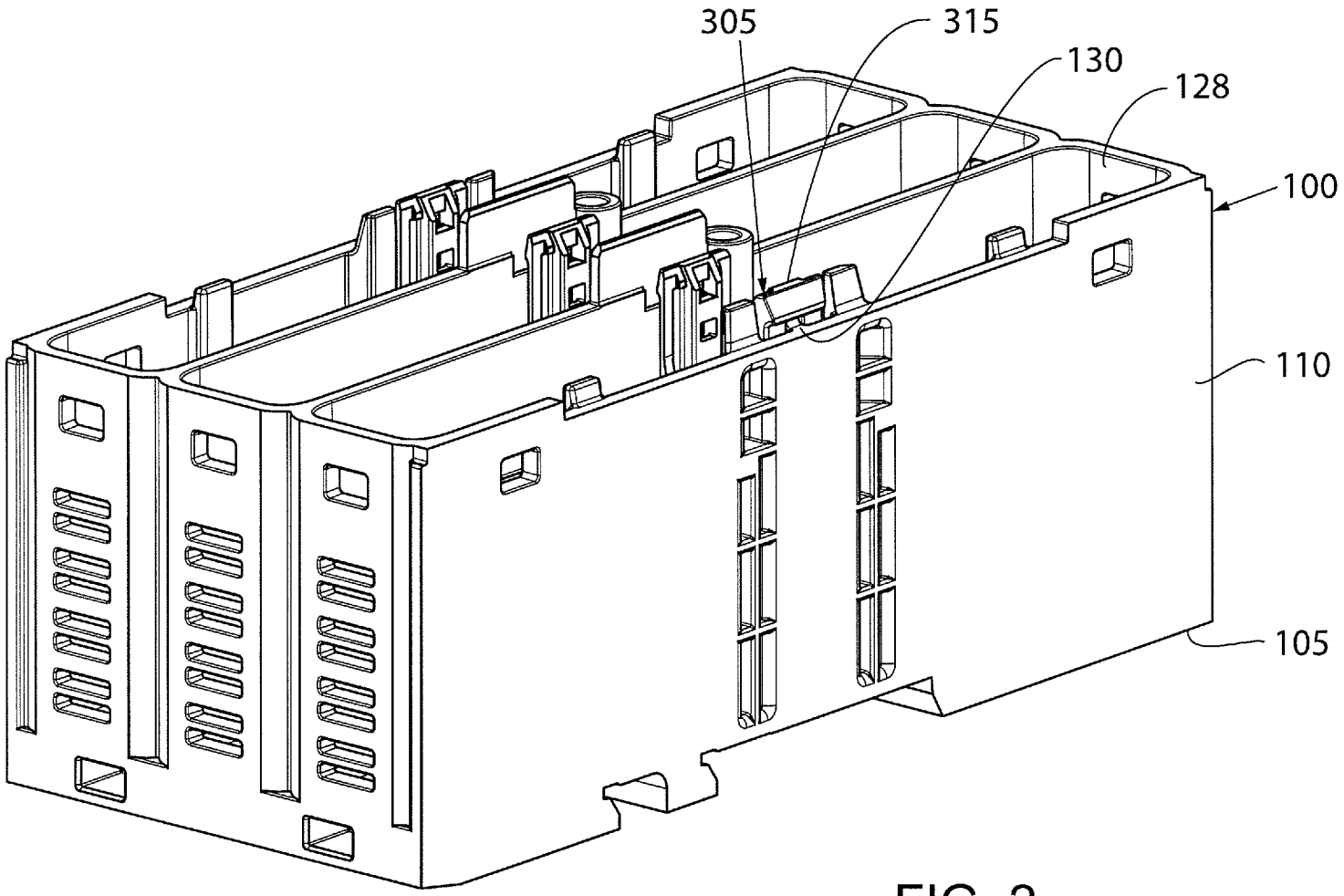
FIG. 2 is a perspective view of a rear housing engaged with a first splitter plate panel.
Figure 3:
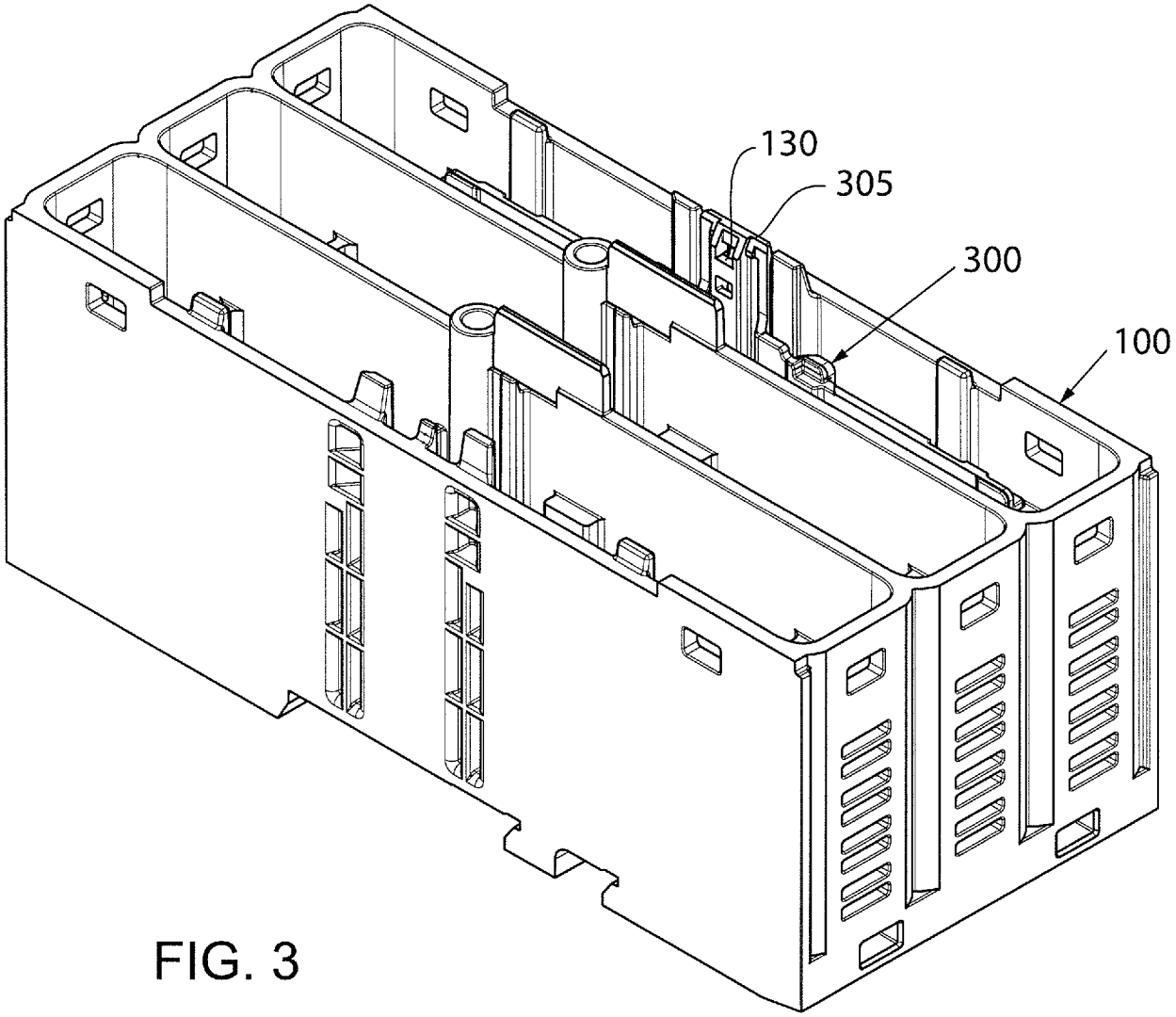
FIG. 3 is a top left perspective view of the rear housing of FIG. 2.
Figure 4:
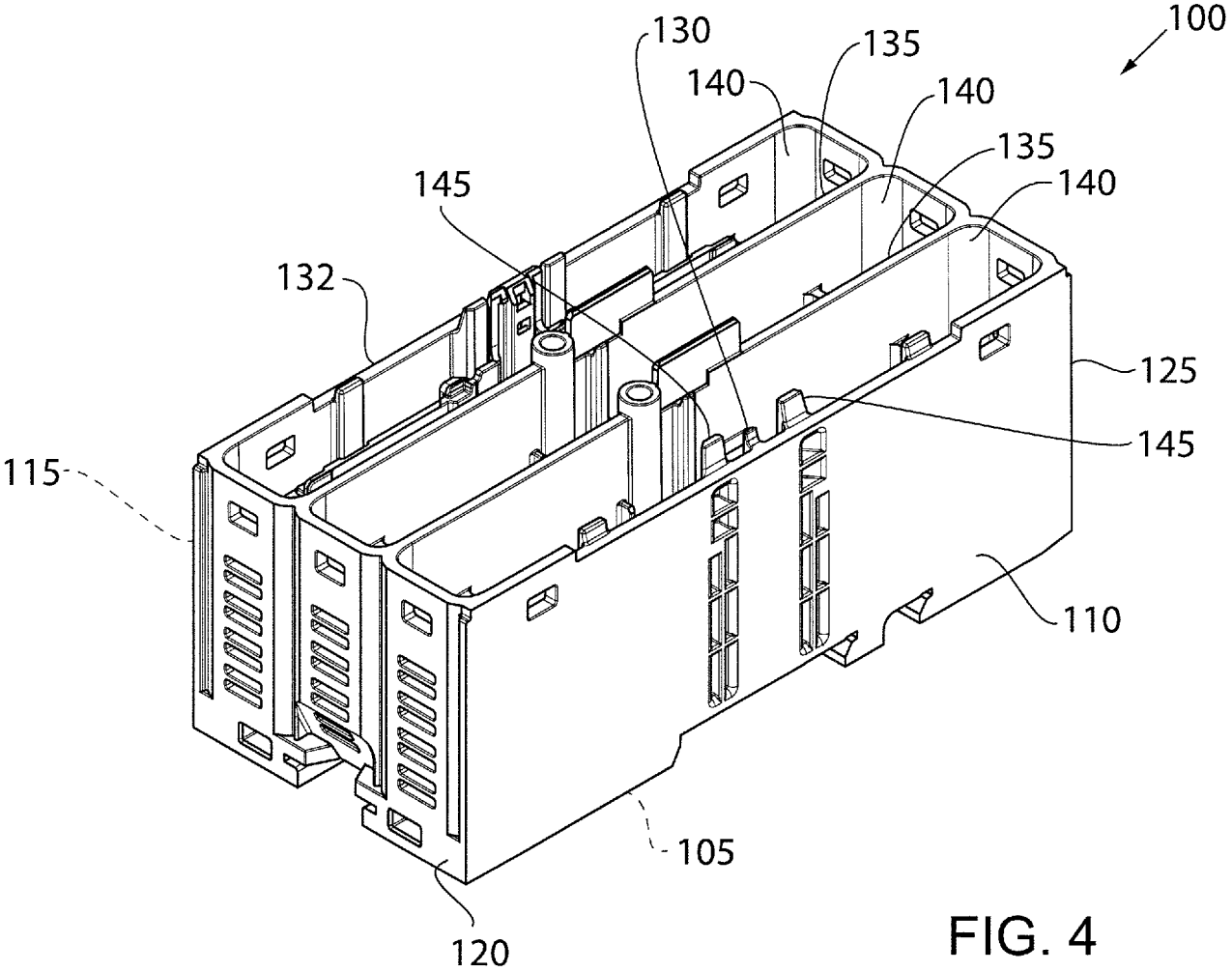
FIG. 4 is a top right perspective view of the rear housing of FIGS. 2 and 3.
Figure 5:
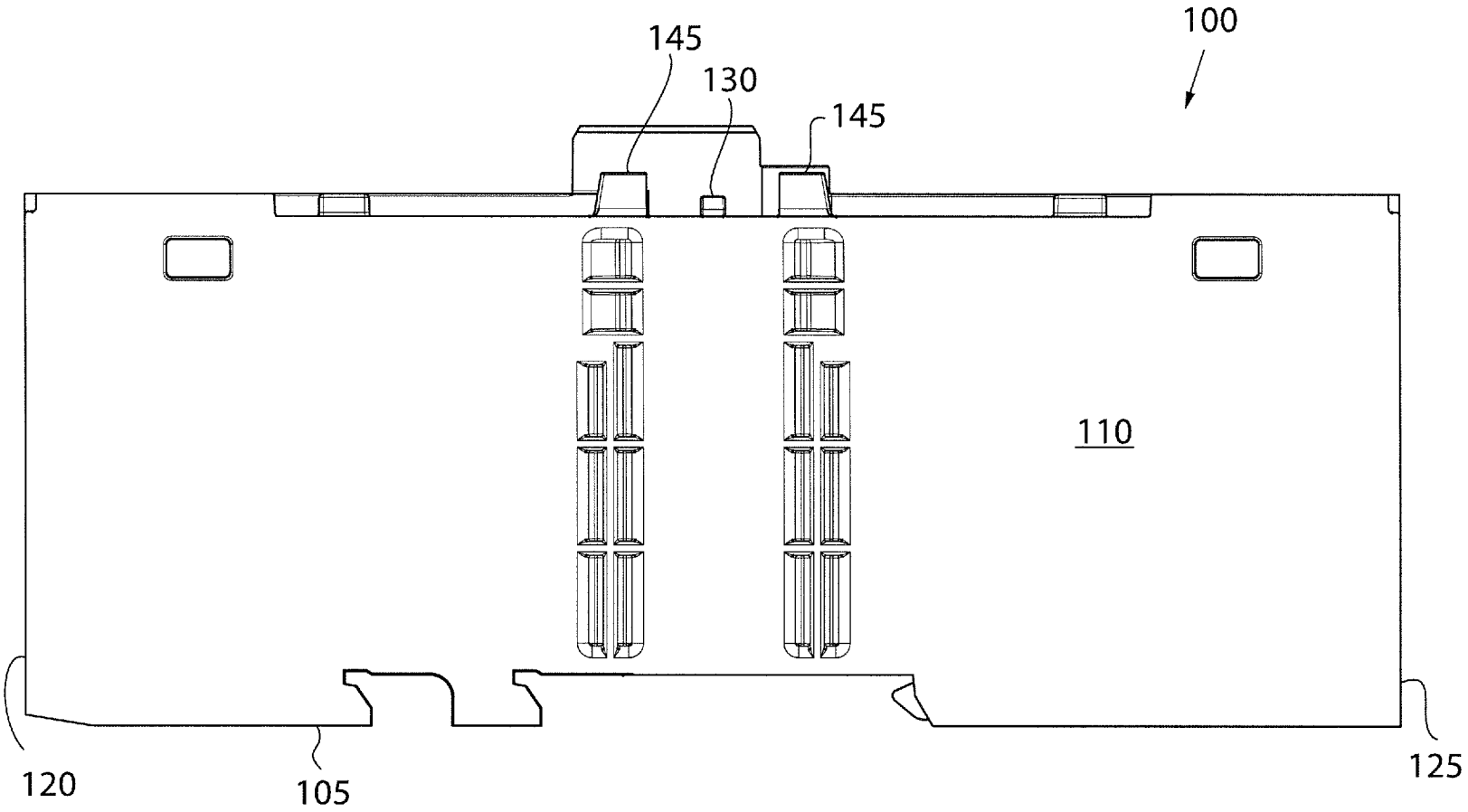
FIG. 5 is a side elevation view of the rear housing of FIGS. 2-4.
Figure 6:
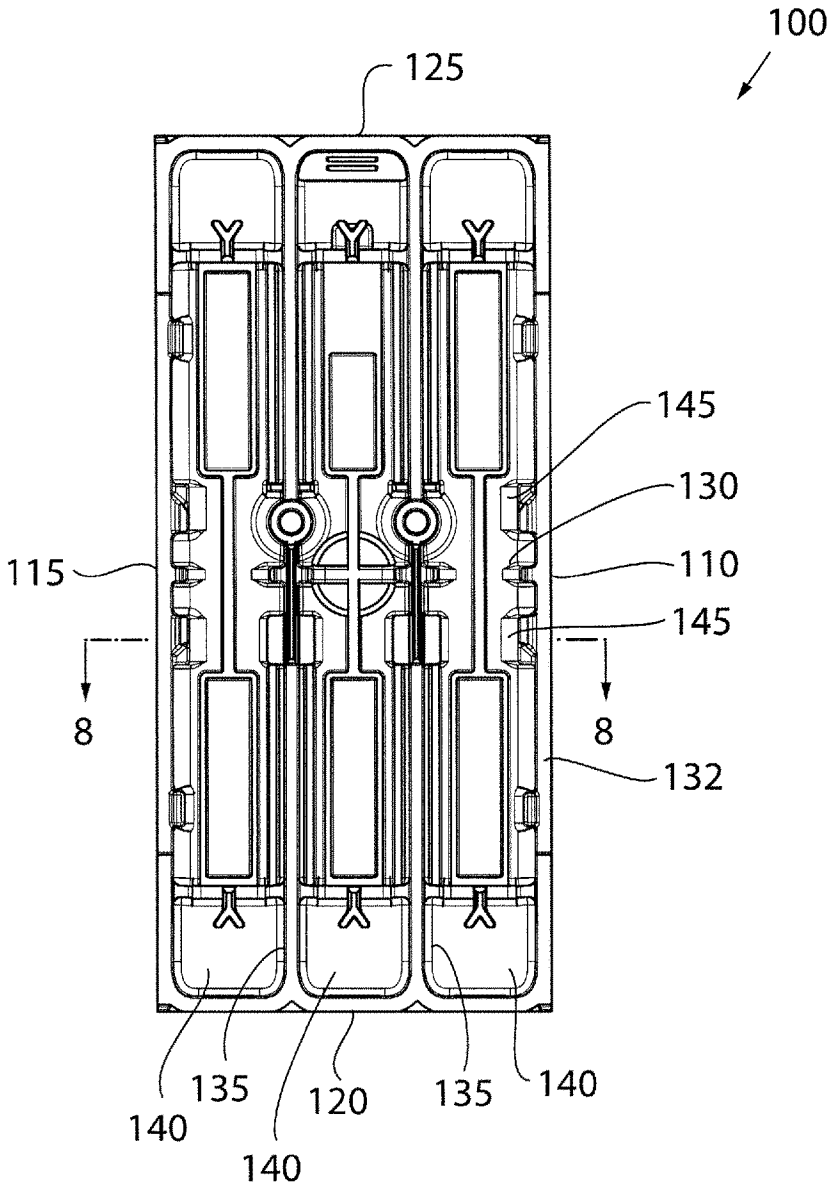
FIG. 6 is a top plan view of the rear housing of FIGS. 2-5.
Figure 7:
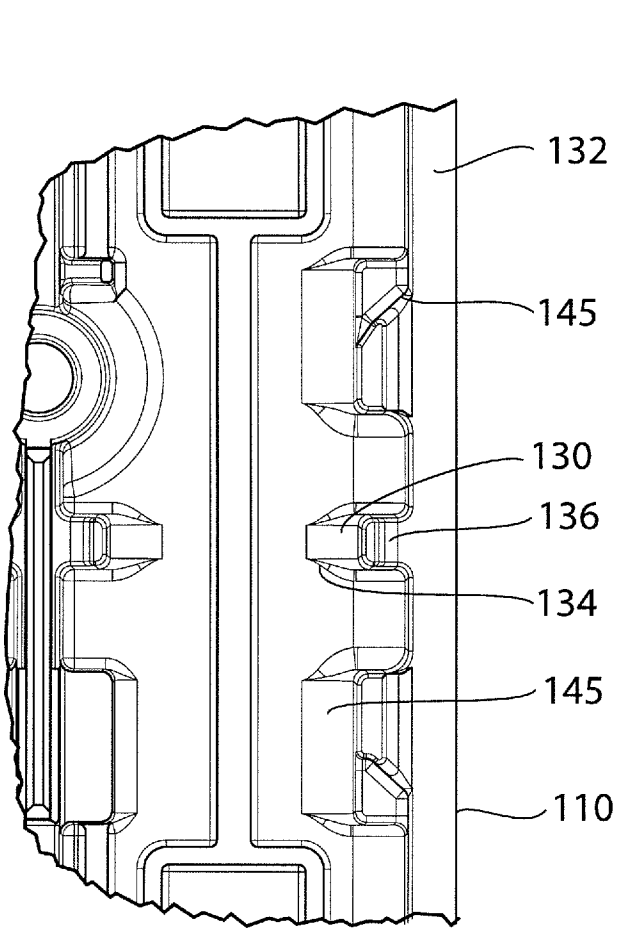
FIG. 7 is a close-up view of the top plan view of the rear housing illustrated in FIG. 6.
Figure 8:
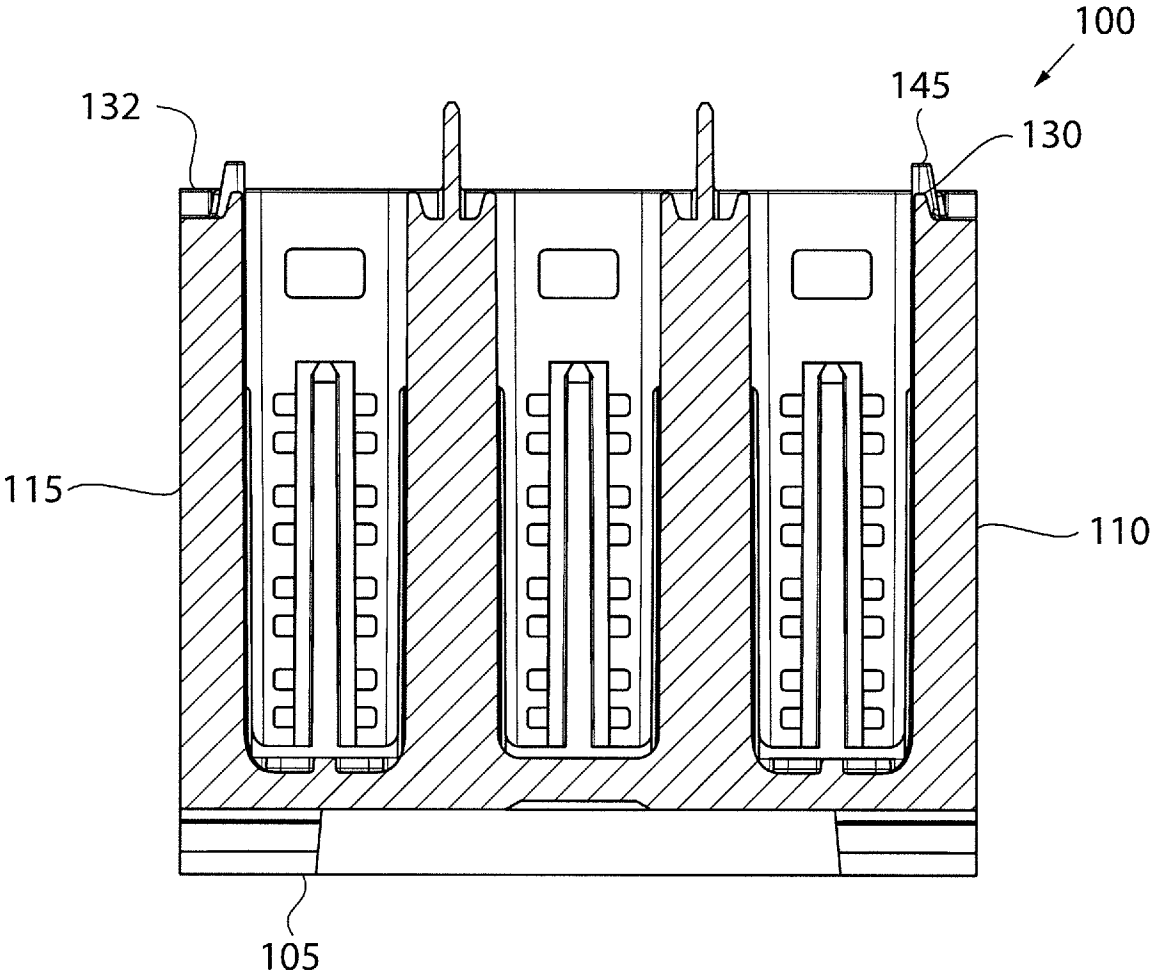
FIG. 8 is a sectional view of the rear housing taken across lines 8-8 in FIG. 6.
Figure 9:
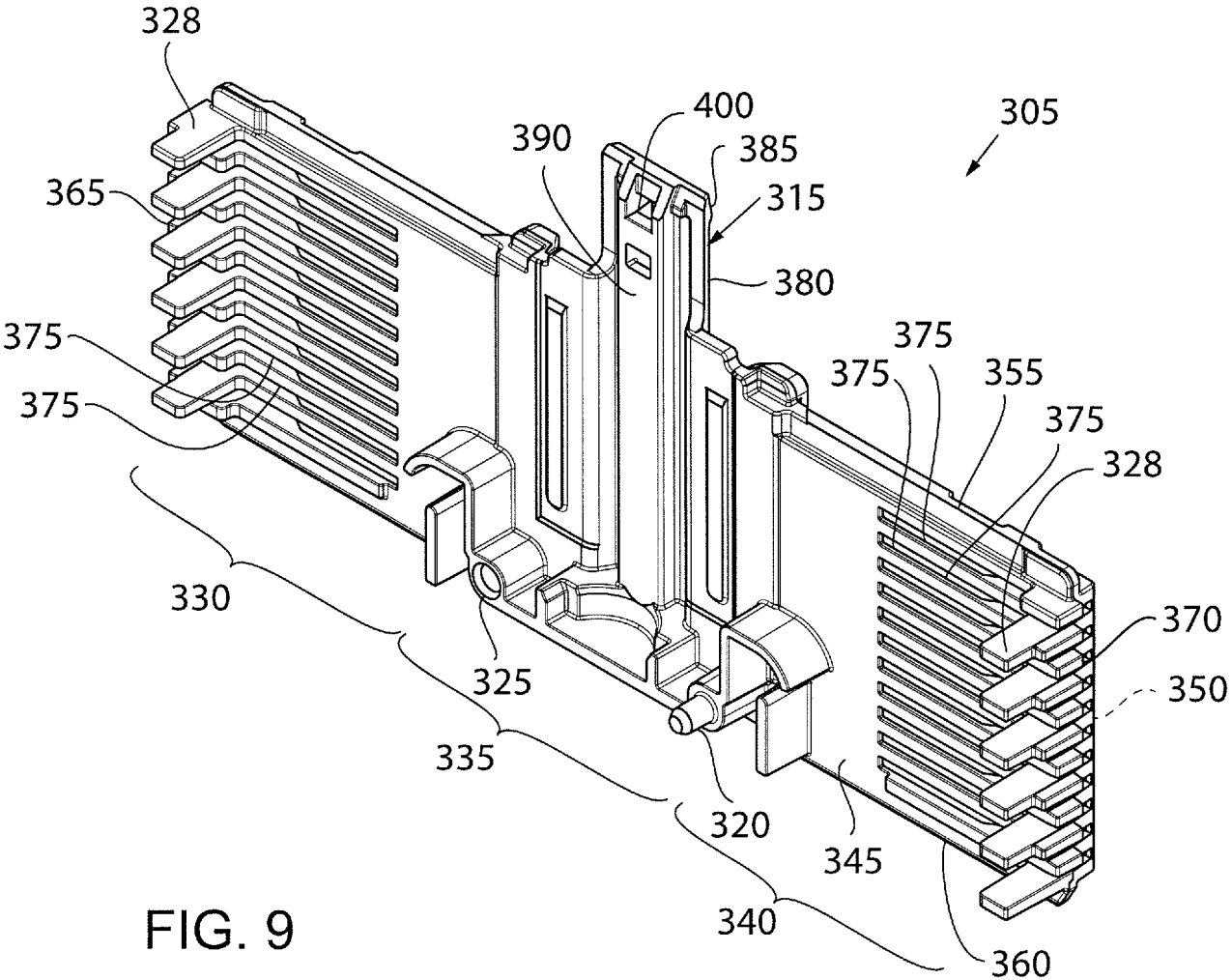
FIG. 9 is a left perspective view of the first splitter plate panel.
Figure 10:
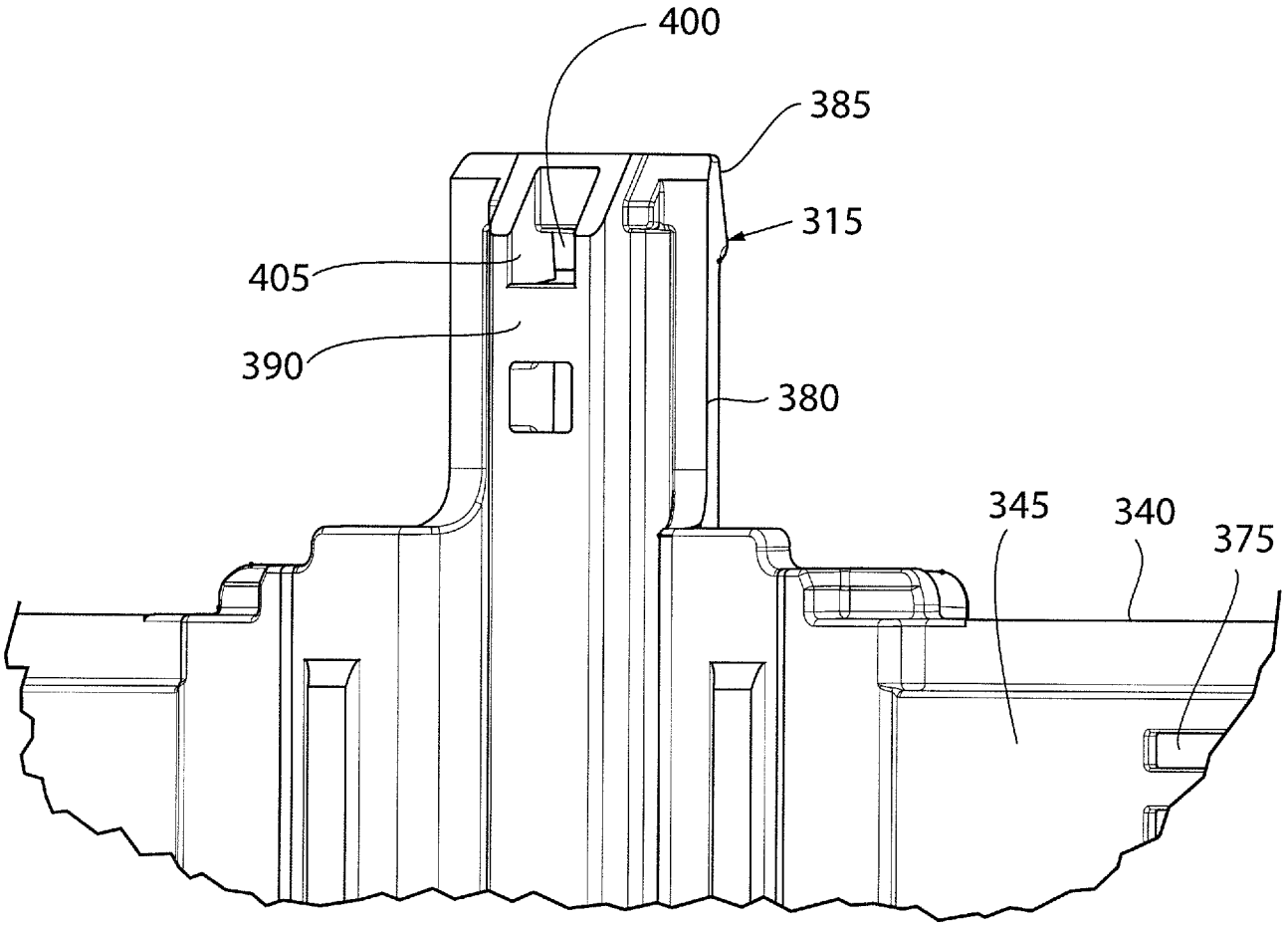
FIG. 10 is a close-up view of the first splitter plate panel illustrated in FIG. 9.
Figure 11:
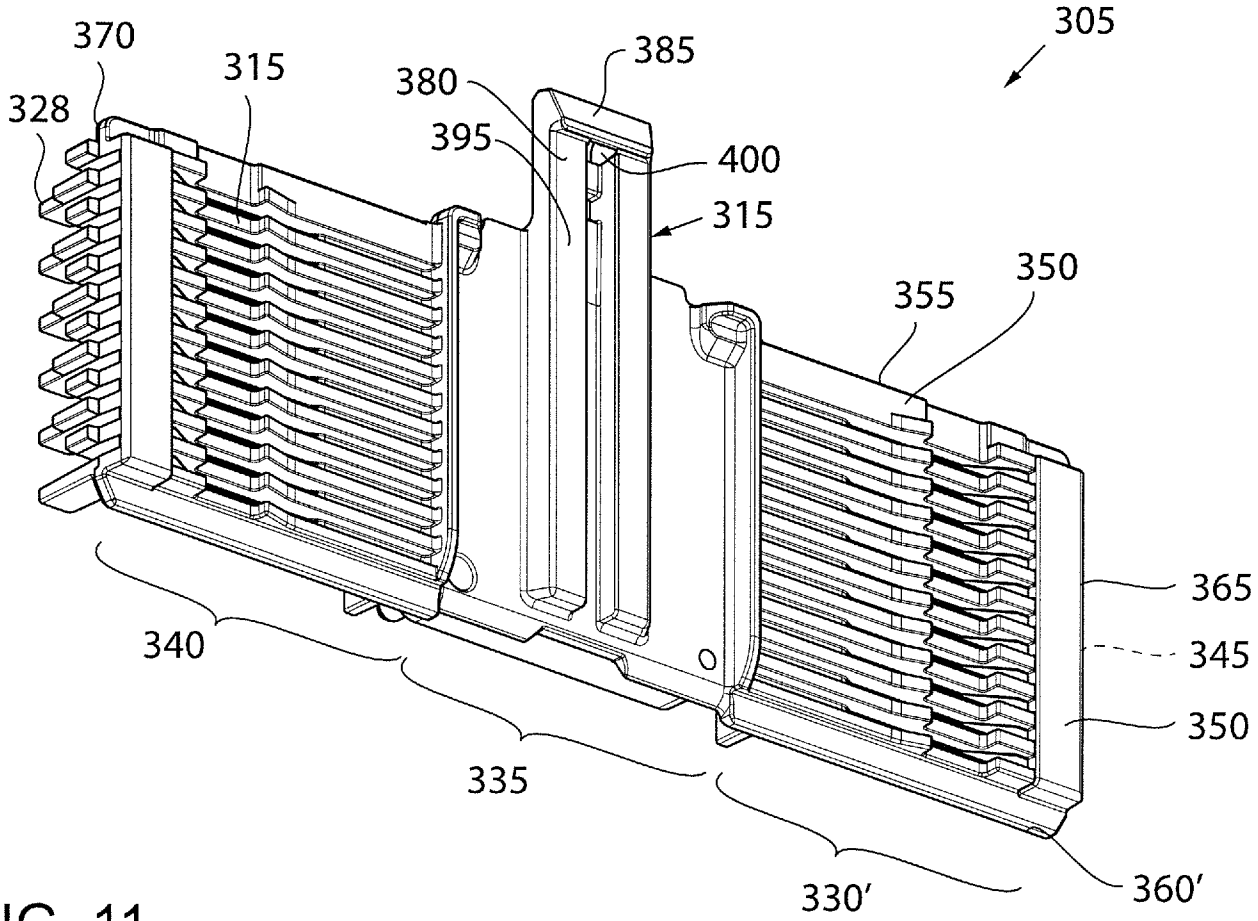
FIG. 11 is a right perspective view of the first splitter plate panel of FIGS. 9 and 10.
Figure 12:
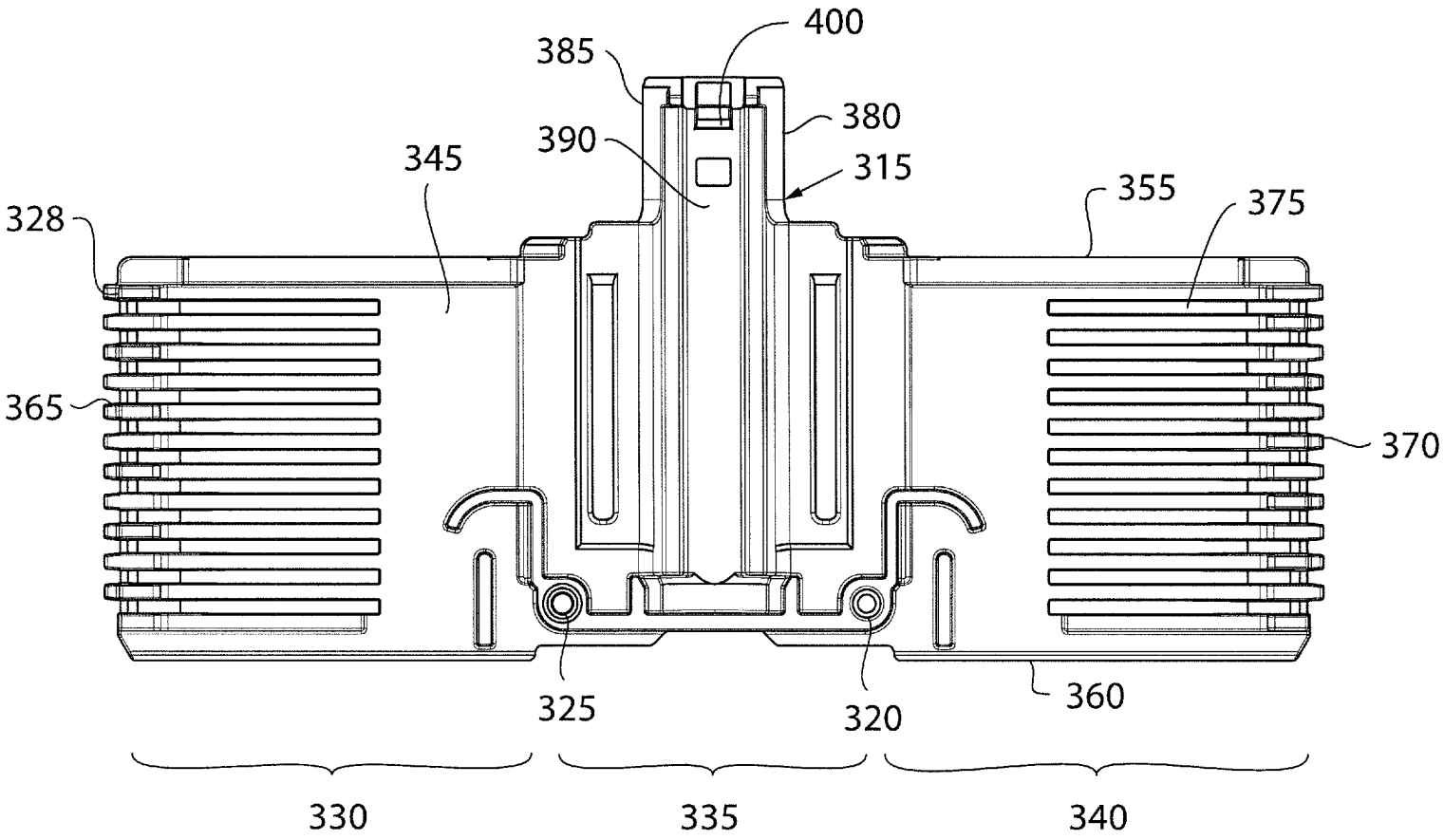
FIG. 12 is a left elevation view of the first splitter plate panel of FIGS. 9-11.
Figure 13:
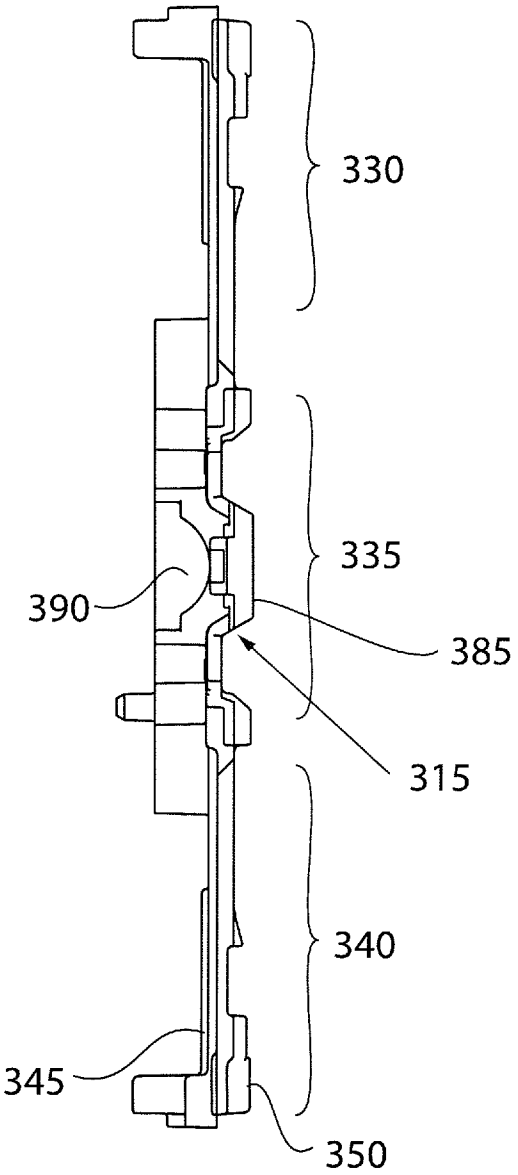
FIG. 13 is a top plan view of the first splitter plate panel of FIGS. 9-12.
Figure 14:
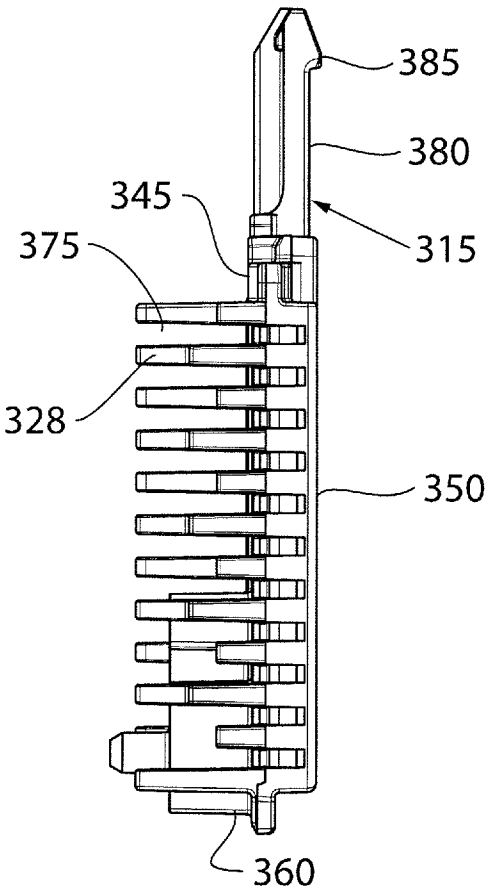
FIG. 14 is a front elevation view of the first splitter plate panel of FIGS. 9-13.
Figure 18:
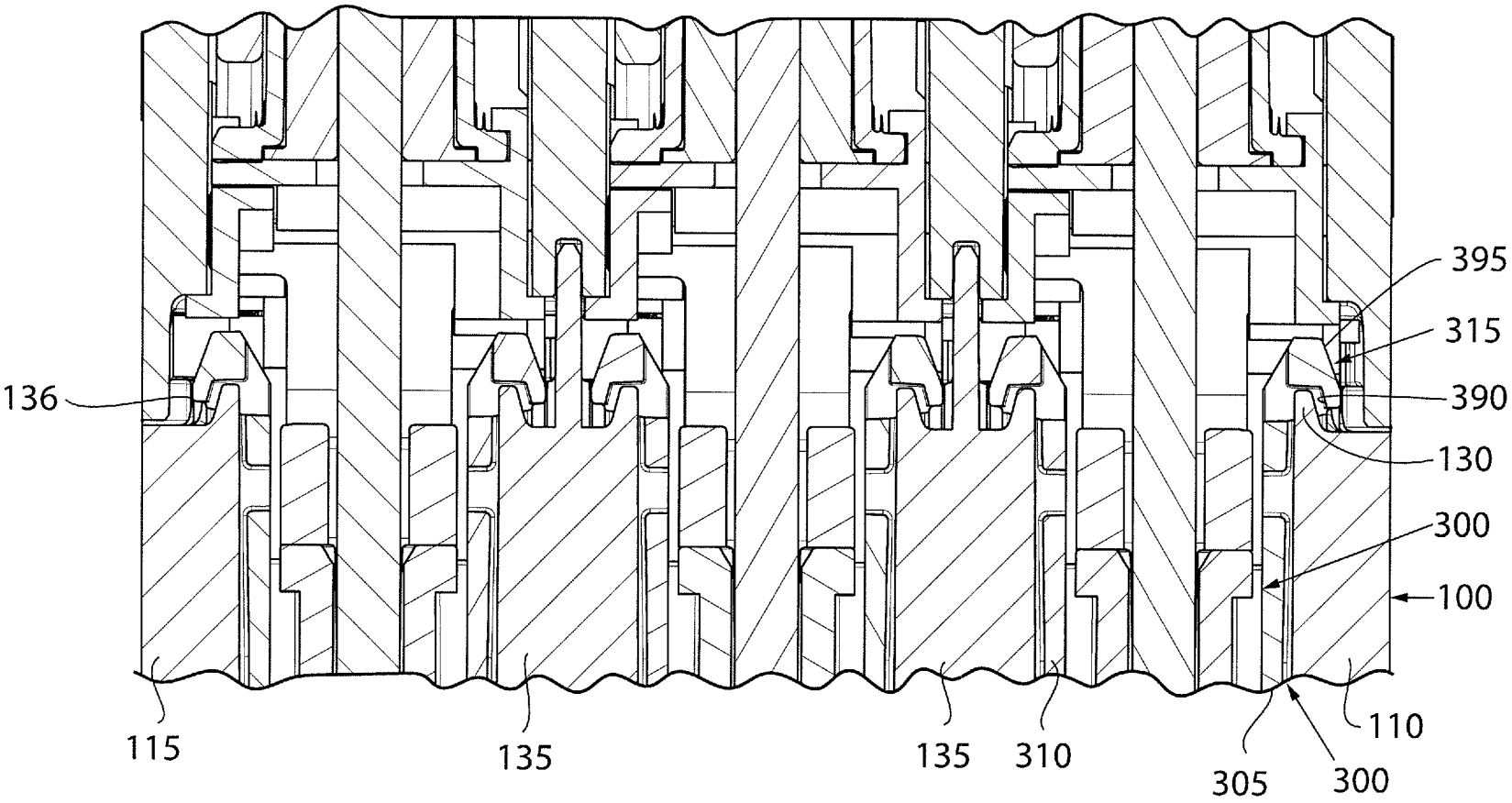
FIG. 18 a partial sectional view of the switching device of FIG. 1 illustrating engagement of the first splitter plate panel with the rear housing.
Figure 19:
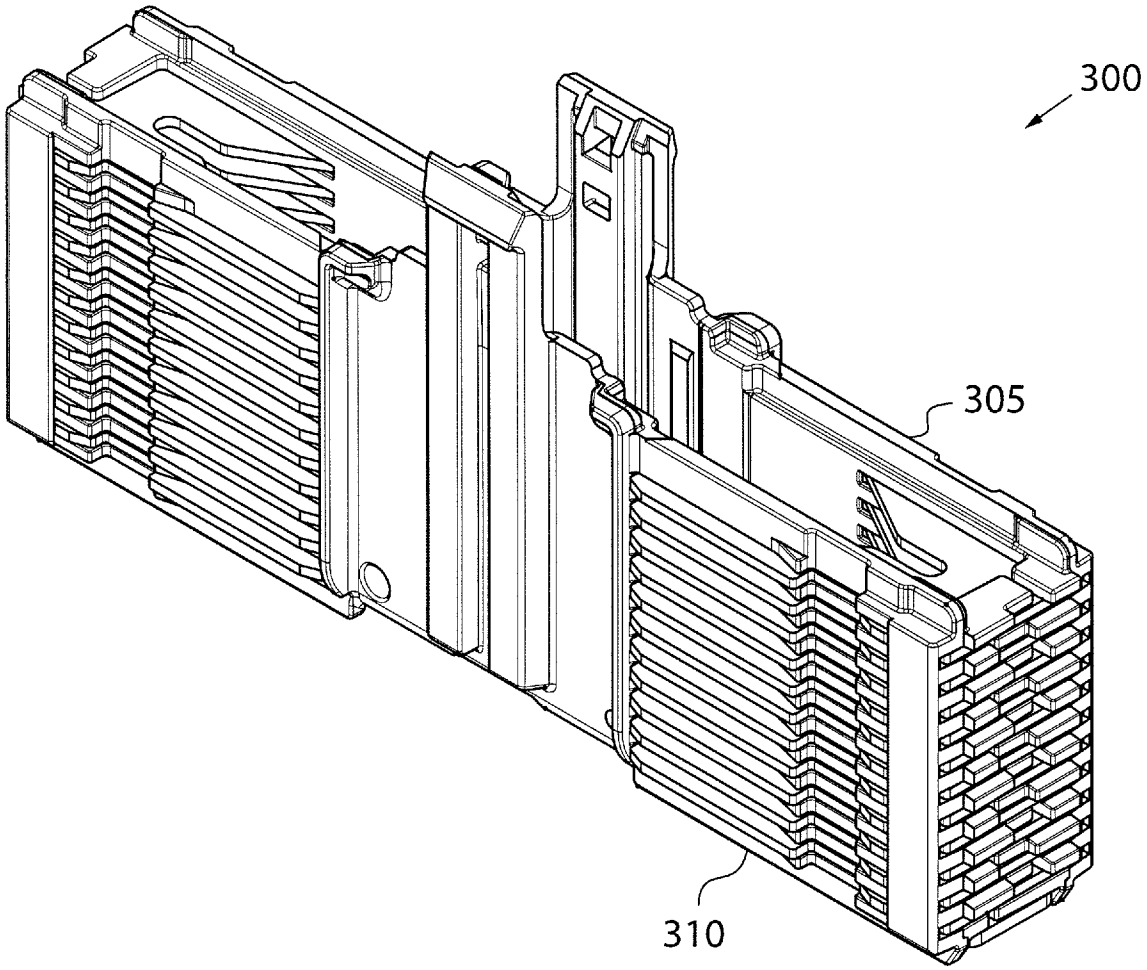
FIG. 19 is a perspective view of the first splitter plate support panel of FIGS. 9-14 and a second splitter plate support panel joined together to form a splitter plate support.

As seen in FIGS. 2 and 3, the rear housing 100 engages with a splitter plate support 300 to reinforce the housing 10. Briefly, and as will be greater detail hereinafter, the rear housing 100 includes a rear housing tab 130 that projects from the sidewall 110, away from rear housing face 105. The splitter plate support 300 (shown in FIGS. 3 and 18) comprises a first support panel 305 and a second support panel 310 (shown in FIG. 18) which engage to form the splitter plate support 300. In one embodiment, the second support panel 310 may be a mirror image of the first support panel 305, illustrated in FIG. 19. The first and second support panels are joined together within the housing 10 of the switching device 5. The interior volume between the first and second support panels defines an arc chamber for one pair of contacts. The contacts move within the center region and each end region is configured to support a series of splitter plates (not shown). The splitter plates are configured to help draw any arc within the chamber toward the plates and to help suppress the arc.

The first support panel 305 includes a support hook 315 through which the rear housing tab 130 extends thereby allowing the first support panel 305 and the sidewall 110 of the rear housing 100 to engage each other. The engagement of the first support panel 305 and sidewall 110 through the rear housing tab 130 and support hook 315 reinforces the sidewall 25 of the housing by creating a double-walled portion in at least one region of the sidewall 25 of the housing 10.

In more detail, and as illustrated in FIGS. 4-8, the rear housing 100 may be a rectangular housing or shell having an interior chamber 128, with an inner surface 134 and outer surface 136 located opposite from the inner surface 134. The rear housing 100 includes the first sidewall 110 and second sidewall 115, located opposite from each other, and the first end wall 120 and the second end wall 125 both located in between the sidewalls 110, 115 and opposite from each other. A surface of the sidewalls 110, 115 and end walls 120, 125 located furthest from the rear housing face 105 form a perimeter or edge 132 extending around the rear housing. The interior chamber 128 is a volume defined within the first sidewall 110, the second sidewall 155, the first end wall 120, and the second end wall 125 between the rear housing face 105 and the edge 132. In one embodiment, the rear housing 100 may further include at least one interior wall 135 within the interior chamber 128 that extends across the rear housing 100 from the first sidewall 110 towards the second sidewall 115 and from the rear housing face 105 towards the edge 132 to form at least one housing chamber 140. The housing chamber 140 may be shaped and sized so that a splitter plate support 300 may be inserted within the housing chamber 140. The rear housing 100, therefore, defines at least one interior chamber 128, which may further be separated into additional housing chambers 140. The rear housing 100 further includes at least one rear housing tab 130 and at least one rear housing protrusion 145. The rear housing tab 130 and rear housing protrusions 145 may be members that extend from the first sidewall 110 towards the second sidewall 115, as well as projecting away from the rear housing face 105 and past the edge 132. In one embodiment, the rear housing tab 130 is further located in between two rear housing protrusions 145.

Turning to FIGS. 9-14, the splitter plate support 300, comprises the first support panel 305 and the second support panel 310 (shown in FIGS. 18 and 19) coupled together to form the splitter plate support 300. In one embodiment, the first support panel 305 and second support panel 310 each includes a male coupling member 320 and/or female coupling member 325 allowing the first support panel 305 and second support panel 310 to engage each other through a male/female coupling connection. The first support panel 305 and the second support panel 310 may engage each other through other methods in alternative embodiments. The first support panel 305 and second support panel 310 are generally rectangular members with a series of support members 328 extending away and towards the opposite panel 305, 310.

In more detail and, although only the first support panel 305 is described, the second support panel 310 may be a mirror image of the first support panel 305, the first support panel 305 may be generally divided into a first panel region 330, a center panel region 335, and second panel region 340. The center panel region 335 may be located and positioned between the first panel region 330 and the second panel region 340. The first support panel 305 includes an inner panel face 345 and an outer panel face 350, located opposite from the inner panel face 345. The inner panel face 345 and outer panel face 350 both further extend across the regions 330, 335, and 340. The first support panel 305 further includes an upper edge 355 extending between the panel faces 345, 350, as well as a lower edge 360 located opposite from the upper edge 355 and also extending between the panel faces 345, 350. The first support panel 305 also has a first side edge 365 and a second side edge 370, located opposite from the first side edge 365, The first support panel 305 further includes a series of slits 375 forming gaps located extending from the first side edge 365 along a portion of the first panel region 330 toward the center panel region 335. Additional slits 375 for gaps and are located extending from the second side edge 370 along a portion of the second panel region 340 towards the center panel region 335. The first support panel 305, therefore, includes slits 375 in at least a portion of its first and second regions 330, 340. As mentioned previously, the first support panel 305 has support members 328, which are located between the slits 375 at both the side edges 365, 370 and further project generally perpendicularly from the inner panel face 345 and towards the other panel 305, 310. When the first support panel 305 and second support panel 310 are engaged to form the splitter plate support 300, splitter plates (not shown) may be inserted into slots defined, at least in part, by the slits 375 of the first and second support panels 305, 310 and held between consecutive support members 328. The support members 328 position and retain the splitter plates within the slots or slits 375 of the panels 305, 310.

The first support panel 310 further includes the support hook 315 which has an arm portion 380 that extends into a hook portion 385. The support hook 315 has an inner surface 390, extending the length of the support hook 315, and an outer surface 395 located opposite to the inner surface 390. The support hook 315 further includes a support aperture 400 at and extending through the hook portion 385. The support aperture 400 further creates an aperture rim 405 extending around the support aperture 400. As illustrated, the support hook 315 is located at the center panel region 335, with the inner surface 390 of the support hook generally coplanar with the inner panel face 345, the outer surface 395 generally coplanar with the outer panel face 350, and the support hook 315 protruding upward past the upper edge 355 of the support panel 305.

Figure 15:
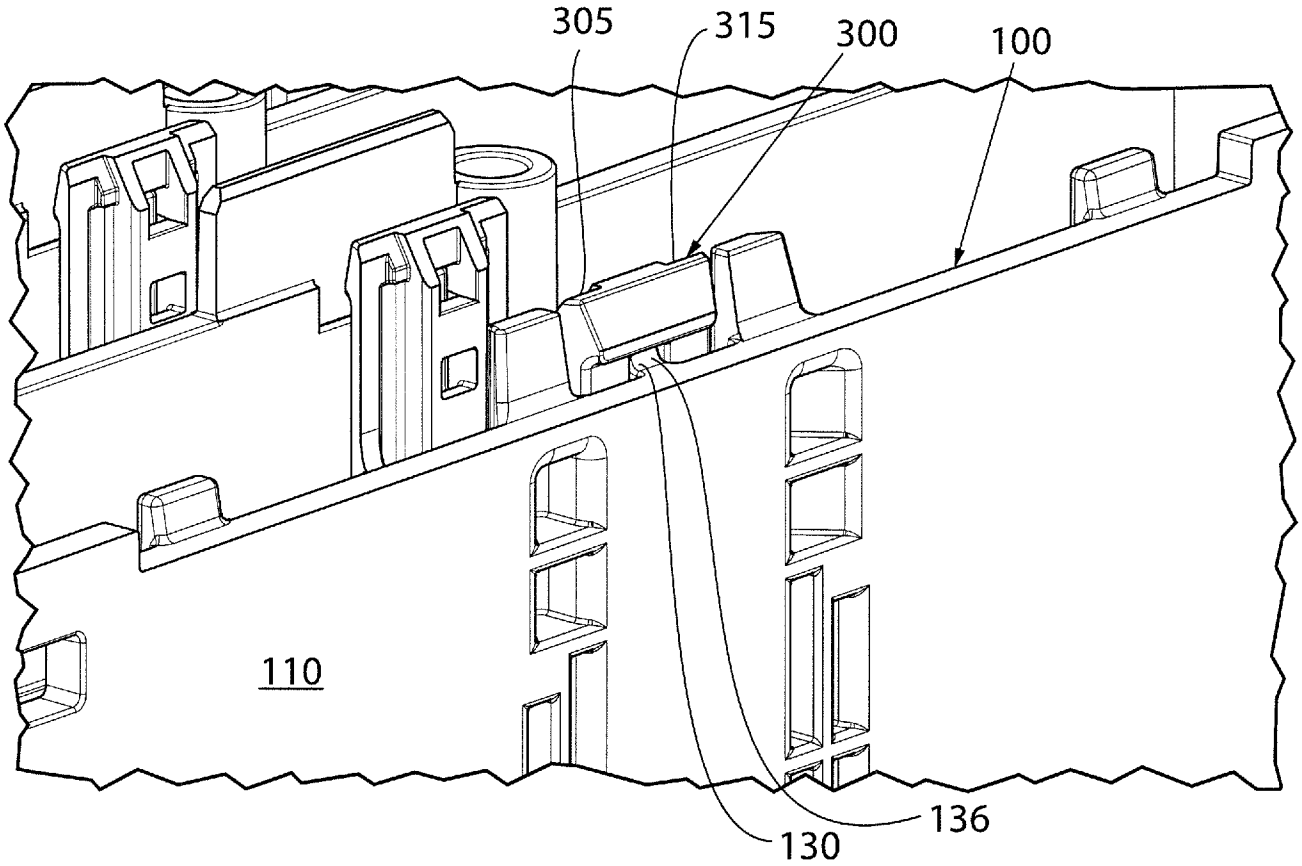
FIG. 15 is a right perspective view of the first splitter plate panel of FIGS. 9-13 engaged with the rear housing of FIGS. 2-6.
Figure 16:
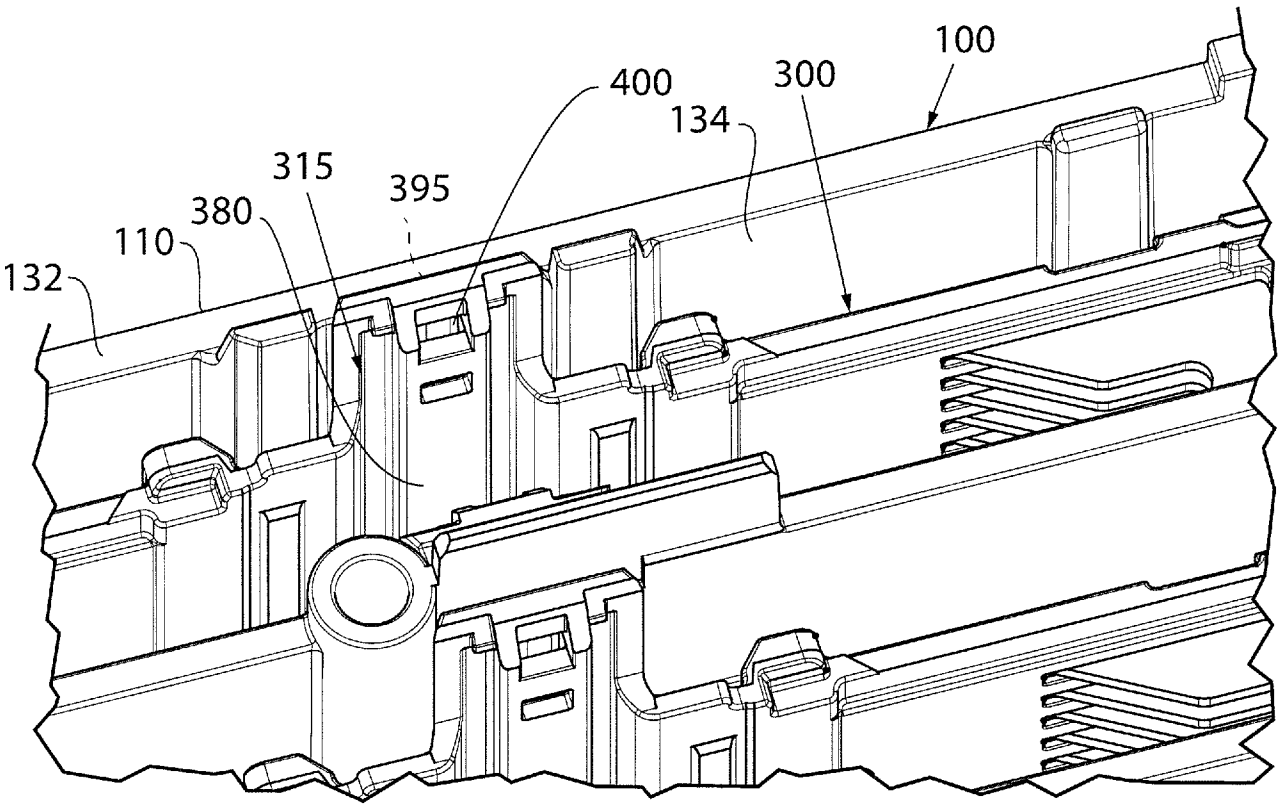
FIG. 16 is left perspective view of the first splitter plate panel of FIGS. 9-13 engaged with the rear housing of FIGS. 2-6.
Figure 17:
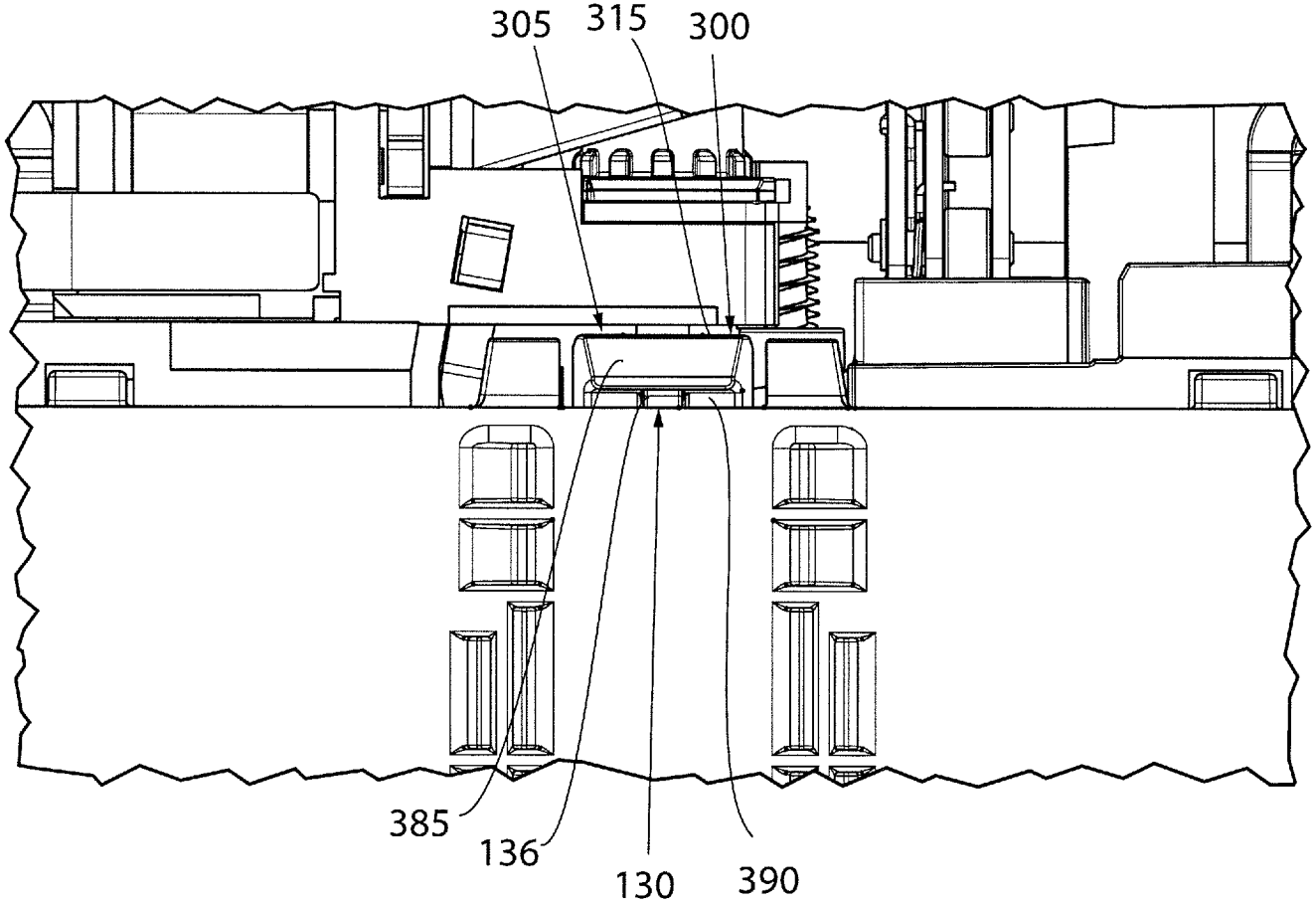
FIG. 17 is a right elevation view of the first splitter plate panel engaged with the rear housing as illustrated in FIG. 15.

The support hook 315 is configured to engage the rear housing tab 130 of the rear housing 100 to reinforce at least a portion of the rear housing 10, as illustrated in FIGS. 15-17, While FIGS. 15 and 16 only illustrate the first support panel 305 and one sidewall 110 of the rear housing 100 coupled together, the opposite sidewall 115 and/or interior walls 135 (see also FIG. 4) may further include rear housing tabs 130 allowing both the support panels 305, 310 to engage the rear housing sidewalls 110, 115 and/or interior walls 135 to further reinforce the housing 10.

To engage the first support panel 305 with the rear housing 100, the rear housing tab 130 may be inserted so that the rear housing tab 130 extends through the support aperture 400. Once the rear housing tab 130 has been inserted into the support aperture 400, the outer surface 136 of the rear housing tab 130 is adjacent and abuts the aperture rim 405, as well as the inner surface 390 of the support hook 315, to prevent lateral movement of the rear housing tab 130 and support hook 315 between the sidewall 110 of the rear housing 100 and the sidewall 60 of the front housing 50. The sidewall 110 of the rear housing 100 and the sidewall 60 of the front housing 50 are further generally coplanar to each other when the sidewall 60 of the front housing 50 extends over the rear housing tab 130 and the support hook 315 as the front housing 50 is mounted or coupled to the rear housing 100. Thus, not only does the engagement of the rear housing tab 130 and support hook 315 ensure that there is no lateral movement of the sidewalls 60, 110 during short circuit events, the overlapping rear housing 100 and support panel 305 further form a double-walled region within at least one region of the housing 10 to further reinforce the housing 10.

Under normal operation, the switching device 5 is configured to selectively open and close a pair of electrical contacts. The electrical contacts are located within an arc chamber defined, at least in part, between opposing support plates 305, 310. When contacts are separated under load, an arc is generated between the two contacts as the contacts separate. The splitter plates (not shown) supported by the support plates 305, 310 are configured to draw the arc toward the plates and to rapidly extinguish the arc.

Under fault conditions, however, such as a short circuit or ground fault condition in a load being supplied power via the switching device 5, the amount of current can be many times greater than the amount of current expected under normal operation. The arc generated while opening contacts under a fault condition can result in plasma generation within the arc chamber, rapidly increasing the temperature and pressure within the arc chamber. Although the splitter plates are configured to conduct and help extinguish the arc and the slits 375 in the support panels 305, 310 are configured to vent the pressure built up within the arc chamber, the rapid increase in temperature and pressure may exceed the ability of the splitter plates to extinguish the arc and the ability of the slits 375 to vent the excess pressure. Under prior designs of the switching device 5, the sidewall 110 of the rear housing 100 would be deflected outward as a result of the excess temperature and pressure built up in the arc chamber.

The present invention reinforces the sidewall 110 of the rear housing 100 to prevent lateral deflection under the afore-described fault condition. The rear housing tab 130 extends through the aperture 400 in the support hook 315. Thus, when pressure is vented through the slits 375 of the support panels 305, 310 and within the interior chamber 128 of the rear housing 100, the pressure exerts an outward force on the sidewalls 110, 115 of the rear housing 100. The outward force on the sidewall, however, causes the outer surface 136 of the rear housing tab 130 to engage the support hook 315, preventing lateral motion of the sidewall 110 away from the support panel 305, 310 to which the sidewall 110 is engaged. Because the rear housing tab 130 is engaged with the aperture 400 in the support hook 315, the combined strength of both the support panel 305, 310 and the sidewall 110 resist lateral motion of the housing 10, allowing the housing 10 of the switching device 5 to survive the arc generated under the fault condition.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

In the preceding specification, various embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

We claim:

1. A switching device for industrial equipment comprising:

a housing further comprising a front housing configured to be mounted to a rear housing; the rear housing further comprising:

a rear housing face, a first sidewall and a second sidewall located opposite the first sidewall, a first end wall and a second end wall opposite the first end wall, wherein each of the first sidewall, the second sidewall, the first end wall, and the second end wall extend from the rear housing face, defining at least one interior chamber therebetween, and a rear housing tab extending from the first sidewall of the rear housing; and a splitter plate support located within the at least one interior chamber, the splitter plate support further comprising a first support panel including:

an outer panel face of the first support panel configured to be oriented adjacent an inner surface of the first sidewall of the rear housing, and a support hook extending from the outer panel face, wherein the rear housing tab engages the support hook to, at least in part, connect the first support panel to the first sidewall of the rear housing.

2. The switching device of claim 1 wherein the support hook includes an aperture and the rear housing tab extends through the aperture.

3. The switching device of claim 2 wherein:

the first sidewall includes the inner surface, an outer surface, and an edge;

the edge extends between the inner surface and the outer surface along a surface of the rear housing opposite the rear housing face; and the rear housing tab extends beyond the edge of the first sidewall along the inner surface of the first side wall.

4. The switching device of claim 3 wherein:

the support hook further includes a hook portion extending outward from the outer panel face, the aperture extends upward through the hook portion, and when the rear housing tab is inserted through the aperture, the hook portion is oriented over the edge of the first sidewall.

5. The switching device of claim 1 wherein the first support panel further comprises:

a first panel region, a center panel region, and a second panel region, wherein the support hook extends from the center panel region.

6. The switching device of claim 1 wherein the first sidewall and the first support panel form a double-wall panel thereby reinforcing the housing.

7. The switching device of claim 1, wherein:

the front housing further comprises:

a front housing face, a first sidewall and a second sidewall opposite the first sidewall, and a first end wall and a second end wall opposite the first end wall, wherein:

each of the first sidewall, second sidewall, first end wall, and second end wall extend around the front housing face, defining at least one interior chamber therebetween, and the first sidewall of the front housing is configured to extend over the rear housing tab and the support hook and to be generally coplanar to the first sidewall of the rear housing when the front housing is mounted to the rear housing.

8. The switching device of claim 7 wherein the engagement of the rear housing tab with the support hook resists lateral movement of the rear housing tab and support hook outside of the first sidewall of the front housing when a short circuit event occurs within the switching device.

9. The switching device of claim 1, wherein the rear housing tab is a first rear housing tab, the outer panel face is a first outer panel face, and the support hook is a first support hook, the switching device further comprising:

a second rear housing tab extending from the second sidewall of the rear housing; and a second support panel comprising:

a second outer panel face of the second support panel configured to be oriented adjacent an inner surface of the second sidewall of the rear housing, and a second support hook extending from the second outer panel face, wherein the second rear housing tab engages the second support hook to, at least in part, connect the second support panel to the second sidewall of the rear housing.

10. A switching device for industrial equipment comprising:

a housing further comprising a front housing is mounted to a rear housing;

a rear housing tab extending from the rear housing toward the front housing; and a splitter plate support configured to be inserted into the rear housing, the splitter plate support further comprising a first support panel, wherein:

the first support panel includes an aperture, and the rear housing tab is configured to extend through the aperture when the splitter plate support is mounted with the rear housing.

11. The switching device of claim 10 wherein:

the rear housing includes a sidewall having an inner surface, an outer surface, and an edge;

the edge extends between the inner surface and the outer surface; and the rear housing tab extends beyond the edge of the sidewall along the inner surface of the side wall.

12. The switching device of claim 11 wherein:

the first support panel includes a support hook the support hook further includes a hook portion through which the aperture extends upward, and when the rear housing tab is inserted through the aperture, the hook portion is oriented over the edge of the sidewall.

13. The switching device of claim 10 wherein the rear housing includes:

a rear housing face, a first sidewall, a first end wall, a second sidewall, and a second end wall, wherein each wall projects away from the rear housing face to form a perimeter extending around the rear housing face.

14. The switching device of claim 10 wherein the first support panel further includes a support hook, the support hook having an inner surface and an outer surface located opposite to the inner surface, the rear housing tab having an inner surface and an outer surface, wherein the inner surface of the support hook is adjacent to and abuts the outer surface of the rear housing tab.

15. The switching device of claim 10 wherein a first sidewall of the front housing extends over the engagement of the rear housing tab and the aperture such that the first sidewall of the front housing and a first sidewall of the rear housing are generally coplanar when the front housing is mounted to the rear housing.

16. The switching device of claim 15 wherein the engagement of the rear housing tab and the first support panel prevents lateral separation of the rear housing from the front housing.

17. A method of reinforcing side walls of a housing of a switching device for industrial equipment, the method comprising:

inserting a splitter plate support within a rear housing of the switching device;

engaging a rear housing tab with a support hook on the splitter plate support as the splitter plate support is inserted into the rear housing, wherein the rear housing tab extends from a side wall of the rear housing; and mounting a front housing to the rear housing of the switching device, wherein, when the front housing is mounted to the rear housing:

a sidewall of the front housing extends over the rear housing tab and support hook, the sidewall of the front housing is generally coplanar with the sidewall of the rear housing, and the sidewalls of the front housing and of the rear housing define a sidewall of the housing of the switching device.

18. The method of claim 17 wherein the step of engaging the rear housing tab with the support hook further comprises the step of inserting the rear housing tab through an aperture in the support hook.

19. The method of claim 17 wherein the support hook includes a curved portion which extends over a top edge of the side wall of the rear housing.

20. The method of claim 17 wherein the engagement of the rear housing tab with the support hook resists lateral movement of the rear housing with respect to the front housing.

* * * * *